US008936095B2

(12) United States Patent
Ocalan et al.

(10) Patent No.: US 8,936,095 B2
(45) Date of Patent: Jan. 20, 2015

(54) METHODS OF MAGNETIC PARTICLE DELIVERY FOR OIL AND GAS WELLS

(75) Inventors: Murat Ocalan, Boston, MA (US); Manuel Marya, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 505 days.

(21) Appl. No.: 12/790,151

(22) Filed: May 28, 2010

(65) Prior Publication Data

US 2011/0290506 A1 Dec. 1, 2011

(51) Int. Cl.

| | |
|---|---|
| ***E21B 29/00*** | (2006.01) |
| ***E21B 34/00*** | (2006.01) |
| ***E21B 33/00*** | (2006.01) |
| ***E21B 41/00*** | (2006.01) |

(52) U.S. Cl.

CPC ..... *E21B 33/00* (2013.01); *E21B 34/00* (2013.01); *E21B 41/00* (2013.01)

USPC ..... 166/376; 166/381

(58) Field of Classification Search

USPC ..... 166/376, 381

See application file for complete search history.

(56) References Cited

U.S. PATENT DOCUMENTS

| | | | | |
|---|---|---|---|---|
| 4,921,044 | A | 5/1990 | Cooksey | |
| 5,226,483 | A | 7/1993 | Williamson, Jr. | |
| 5,316,688 | A | 5/1994 | Gladfelter et al. | |
| 5,955,144 | A | 9/1999 | Sinclair et al. | |
| 6,380,136 | B1 | 4/2002 | Bates et al. | |
| 6,387,986 | B1 | 5/2002 | Moradi-Araghi et al. | |
| 6,723,683 | B2 | 4/2004 | Crossman et al. | |
| 6,840,318 | B2 | 1/2005 | Lee et al. | |
| 7,049,272 | B2 | 5/2006 | Sinclair et al. | |
| 7,196,040 | B2 | 3/2007 | Heath et al. | |
| 7,216,705 | B2 | 5/2007 | Saini et al. | |
| 7,380,600 | B2 | 6/2008 | Willberg et al. | |
| 7,385,523 | B2 | 6/2008 | Thomeer et al. | |
| 7,398,826 | B2 | 7/2008 | Hoefer et al. | |
| 7,428,922 | B2 | 9/2008 | Fripp et al. | |
| 7,654,334 | B2 | 2/2010 | Manson | |
| 7,677,312 | B2 | 3/2010 | Boney et al. | |
| 2003/0234103 | A1 | 12/2003 | Lee et al. | |
| 2004/0043906 | A1 | 3/2004 | Heath et al. | |
| 2006/0175059 | A1 | 8/2006 | Sinclair et al. | |
| 2007/0144741 | A1* | 6/2007 | Cho et al. | 166/255.2 |
| 2007/0181224 | A1 | 8/2007 | Marya et al. | |
| 2007/0193741 | A1 | 8/2007 | Smith | |
| 2008/0149345 | A1 | 6/2008 | Marya et al. | |
| 2008/0149351 | A1 | 6/2008 | Marya et al. | |
| 2009/0075845 | A1 | 3/2009 | Abad et al. | |
| 2009/0095466 | A1 | 4/2009 | Obrejanu | |
| 2009/0211751 | A1* | 8/2009 | Ocalan et al. | 166/248 |
| 2009/0301718 | A1* | 12/2009 | Baser et al. | 166/278 |
| 2010/0224410 | A1* | 9/2010 | Wassell et al. | 175/40 |

* cited by examiner

*Primary Examiner* — Catherine Loikith

(74) *Attorney, Agent, or Firm* — Bridget Laffey; Jakub M. Michna

(57) ABSTRACT

An apparatus and method of conveying magnetic particles into a wellbore is disclosed. A plurality of particles which are magnetically attracted to one another in response to exposure to a magnetic field are delivered downhole via a degradable material. The degradable material confines the particles and conveys the particles to a desired location downhole. The structure comprising the degradable material and the confined particles can be lowered into a subterranean well by a cable or wire, or alternatively released into the well under the influence of gravity and flow induced forces. The material degrades in response to conditions encountered in a subterranean environment thus releasing the particles.

25 Claims, 12 Drawing Sheets

SELECTIVE NIPPLE EXAMPLE 701
703
705
707
709

801
Pressure
813
Flow mode
803
814

805
Force
Shear Mode
807

811
F
Squeeze Mode
809

METHODS OF MAGNETIC PARTICLE DELIVERY FOR OIL AND GAS WELLS

FIELD OF THE DISCLOSURE

This subject disclosure is generally related to magnetic particles, and more particularly to mechanisms for conveying magnetic particles into a wellbore for magnetorheological fluid applications.

BACKGROUND OF THE DISCLOSURE

Magnetorheological materials are typically comprised of magnetizable particles in suspension in a fluid carrier. A magnetorheological material characteristically exhibits rapid and reversible changes in rheological properties which can be controlled by the application of a magnetic field. The shear stress and viscosity of such a material are related to whether the material is in the presence of a magnetic field, termed the on-state, or in the absence of a magnetic field, termed the off-state. In the on-state, the magnetizable particles align with the magnetic field and substantially increase the shear yield stress and viscosity of the material over its off-state value. Substantial changes in fluid properties via the application of magnetic fields make possible the use of magnetorheological fluids in many industrial applications.

Commonly, state-of-the-art magnetorheological (MR) fluids are multiphase materials consisting of magnetizable particles suspended in a liquid carrier fluid. In the off-state MR fluids exhibit properties typical of a dense suspension. In addition to the magnetizable particles, the carrier fluid serves as a continuous non-magnetic material. Some of the carrier fluids typically used is silicone or hydrocarbon oils. An additional component that is often present in MR fluids is a stabilizer, which serves to keep the particles suspended in the fluid.

Magnetorheological fluids are useful for wellbore applications but present some drawbacks for wellbore applications; several are briefly described in the following section. The use of magnetorheological fluids in long and vertical fluid columns (e.g. within a conduit) such as those found in wellbores can cause problems because the fluid density is usually greater than that of the well fluids; thus the magnetorheological fluid may sink before being actuated at a predetermined depth. The introduction of field-responsive fluids in a long column can cause significant differential pressure at wellbore depths because of their high density, thus making the deployment of such fluid over great lengths difficult. Another drawback, presented by such fluids arises from the magnetic nature of the suspended particles. Prior to deploying into a well, oilfield tubulars (e.g. pipes, coupling stocks, etc) are commonly magnetic particle inspected (MPI) to ascertain the absence of surface and shallow subsurface defects that could jeopardize structural integrity. This technique of inspection may lead to remnant magnetization thus attracting magnetic particles creating an issue for delivery of magnetic particles downhole. Finally, the fluid cost may also be prohibitive for economic operations in high fluid volume applications.

SUMMARY OF THE DISCLOSURE

In view of the above, there is a need for improved mechanisms for conveying magnetic particles into a wellbore for magnetorheological fluid applications. The subject technology accomplishes this and other objectives.

The subject technology is directed to an apparatus comprising a plurality of particles which are magnetically attracted to one another in response to exposure to a magnetic field. The plurality of particles is confined within a first material and the first material degrades in response to conditions encountered in a subterranean environment thereby releasing the particles.

In another embodiment the subject technology is directed to an apparatus for delivering magnetic particles downhole comprising a first material which degrades in response to conditions encountered in a subterranean environment and a byproduct is then formed from a chemical reaction between the first material and the conditions encountered in a subterranean environment.

The subject technology is also directed to an apparatus for delivering magnetic particles downhole comprising a plurality of particles which are magnetically attracted to one another in response to exposure to a magnetic field. The apparatus further comprises a flexible membrane which is impermeable to the plurality of particles thus preventing the plurality of particles from flowing away.

In another embodiment the subject disclosure is directed to a method for delivering magnetic particles downhole comprising introducing a plurality of energy field responsive particles which form chains in response to the energy field and confining the particles in a first material, the first material degrading in response to conditions encountered in a subterranean environment thereby releasing the particles.

It should be appreciated that the present technology can be implemented and utilized in numerous ways, including without limitation as a process, an apparatus, a system, a device, a method for applications now known and later developed. These and other unique features of the system disclosed herein will become more readily apparent from the following description and the accompanying drawings.

DETAILED DESCRIPTION

Figure 1:
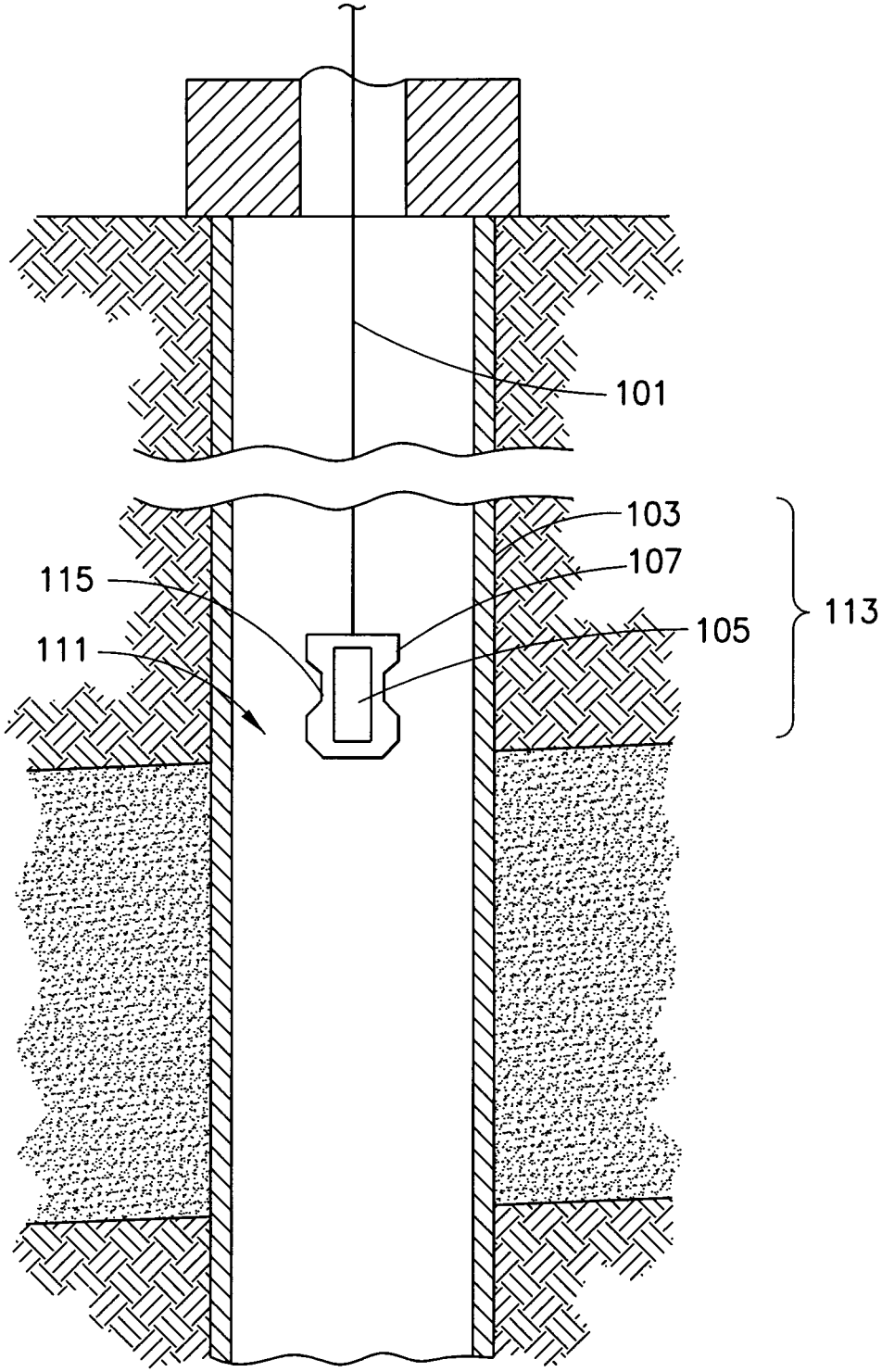
FIG. 1 illustrates a wellsite system in which the subject disclosure can be employed.
Figure 2:
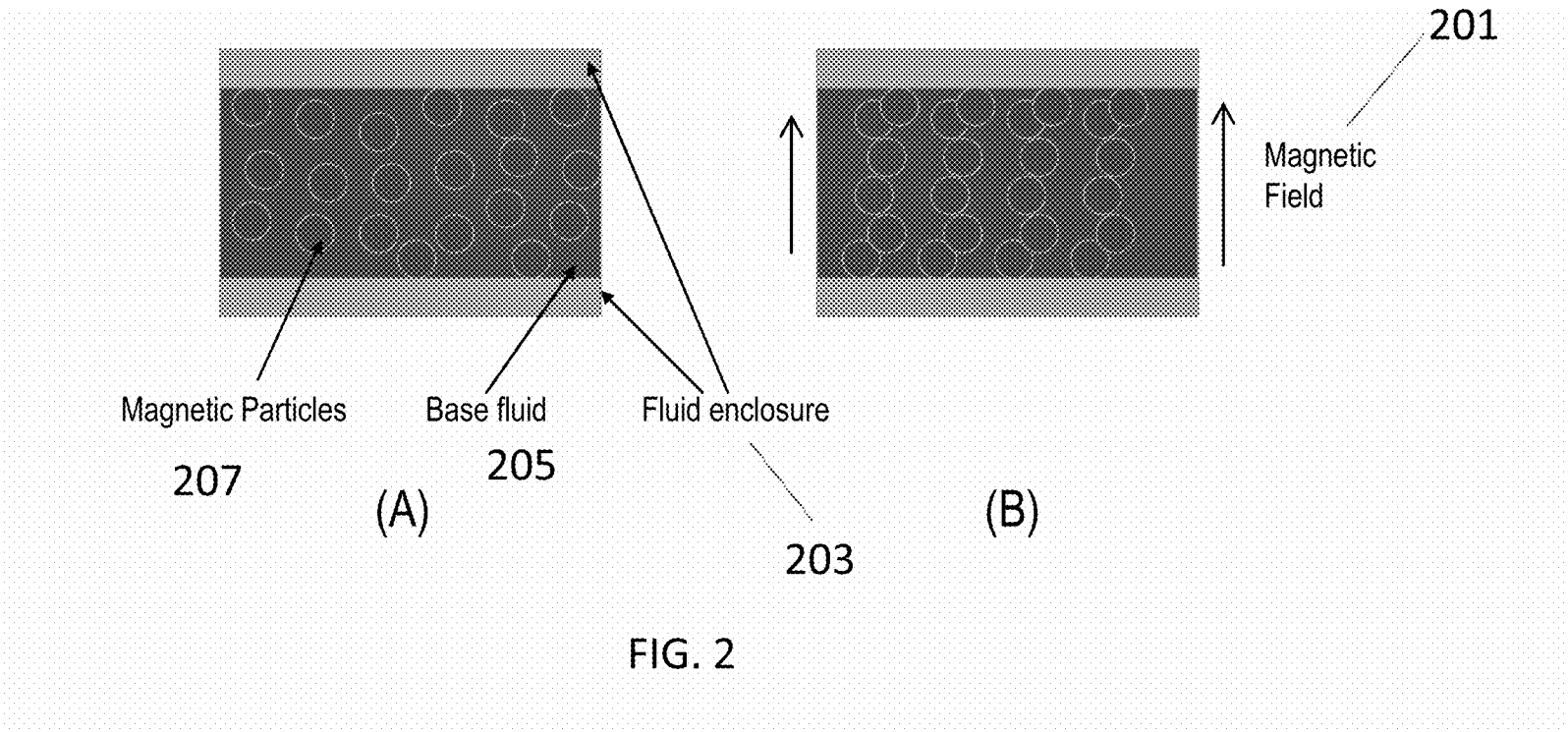
FIGS. 2A-2B illustrates the fluid of FIG. 1 in greater detail.

The subject disclosure is directed to mechanisms of releasing magnetic particles. More particularly, the subject disclosure is directed to mechanisms of deploying magnetic particles downhole for subsequent use within a controlled magnetic field. These released magnetic particles can be used in many downhole applications. In some non-limiting examples magnetic particles are used in mechanisms for mass and flow control. In these applications, the particles released in the downhole environment effectively convert the fluid that suspends them into a magnetorheological fluid. Magnetorheological fluids are typically comprised of a suspension of micrometer-sized magnetic particles. In a non-limiting example magnetorheological fluids comprise 20-40% by volume of micrometer sized particles. Magnetic particles in non-limiting examples may be spherical, ellipsoidal or possibly have a shape similar to fibers. The particles are suspended in a carrier fluid, such as mineral oil, water or silicone oil. A higher volume fraction of magnetic particles typically results in a greater viscosity change due to a larger density of magnetic interactions. Water and oils of varying viscosities are commonly used as carriers which are both found in a downhole environment. Under normal conditions, magnetorheological fluids have flow characteristics similar to that of conventional oil. However, in the presence of a magnetic field, the particles become magnetically polarized and organized into chains of particles within the fluid. FIG. 1 illustrates a wellsite system in which embodiments of the subject disclosure can be disposed. The particle conveyance sub 113 comprises a plurality of magnetic particles 105 confined in a degradable material 107. The material 105 in the illustrated embodiment is lowered into a well 111 with a casing 103 cemented to a portion of a well 111. The particle conveyance sub 113 in the illustrated embodiment is lowered into a wellbore to the desired formation intervals on a line or tubing 101, e.g. in some non-limiting examples wireline, slickline, coiled tubing. In the illustration of FIG. 1 the particle conveyance sub 113 is delivered downhole with a key profile 115 which has a matching landing profile on the production tubing (not illustrated). The subject disclosure may be used in both open-hole and cased wellbores. FIG. 2 illustrates operation of the fluid (205) within a conduit (203), in one non-limiting example, production tubing. The fluid (205) is a magnetorheological fluid including magnetic particles (207) suspended in a base fluid (205). An additive may also be included to assist in suspending the particles and preventing agglomeration. In the absence of a magnetic field the magnetorheological fluid behaves similar to a Newtonian fluid. However, in the presence of magnetic field (201) the particles (207) suspended in the base fluid (205) reversibly align and form chains which are roughly parallel to the magnetic lines of flux associated with the magnetic field. When activated in this manner by a magnetic field, the magnetorheological fluid is in a semi-solid state which exhibits increased resistance to shear in the form of flow or relative motion between fluid boundaries. In particular, resistance to shear is increased due to the magnetic attraction between the particles of the chains. Fluid viscosity is greatly increased and in certain cases the magnetorheological fluid is comparable to a viscoelastic solid. One important aspect of magnetorheological fluids is that yield stress of the magnetorheological fluid in the presence of a magnetic field can be controlled very accurately by varying the magnetic field intensity. The magnetorheological fluids ability to transmit force can be controlled with a magnetic field, therefore, giving rise to the use of magnetorheological fluids in many control based applications.

The chains of particles act to increase the fluid shear strength or flow resistance of the fluid. When the magnetic field is removed, the particles can return to an unorganized state due to the removal of interparticular magnetic interactions and the fluid shear strength or flow resistance of the fluid returns to its previous value. Thus, the controlled application of a magnetic field allows the fluid shear strength or flow resistance of a magnetorheological fluid to be altered very rapidly.

Any magnetizable particle may be used in magnetorheological fluids e.g. ferromagnetic, ferrimagnetic or superparamagnetic. One non-limiting examples of magnetic particles is Iron, including carbonyl iron which is a highly pure (97.5% for grade S, 99.5+% for grade R) iron and is prepared by chemical decomposition of purified iron pentacarbonyl composed of spherical microparticles. Further non-limiting examples include Iron Oxides e.g. FeO, $Fe_2O_3$, $Fe_3O_4$ and Nickel, cobalt and alloys of these usually including iron. Embodiments of the subject disclosure may use any type of magnetic particle and these magnetic particles may be in any shape and in any fraction for mixtures of magnetic particles.

Embodiments of the subject disclosure disclose mechanisms of releasing magnetic particles in well fluids. These magnetic particles are then used in downhole applications. Embodiments of the subject disclosure comprise a degradable material, and in one non-limiting example a dissolvable material. In one non-limiting example the magnetic particles are conveyed by a temporary degradable material. In a further non-limiting example the magnetic particles are generated in-situ by chemical reactions of the degradable material with the environment present, e.g. well fluids. In embodiments of the subject disclosure once the particles have been delivered to the desired location they may be used as components of a magnetorheological fluid downhole system functioning in mass and flow control applications.

Figure 3:
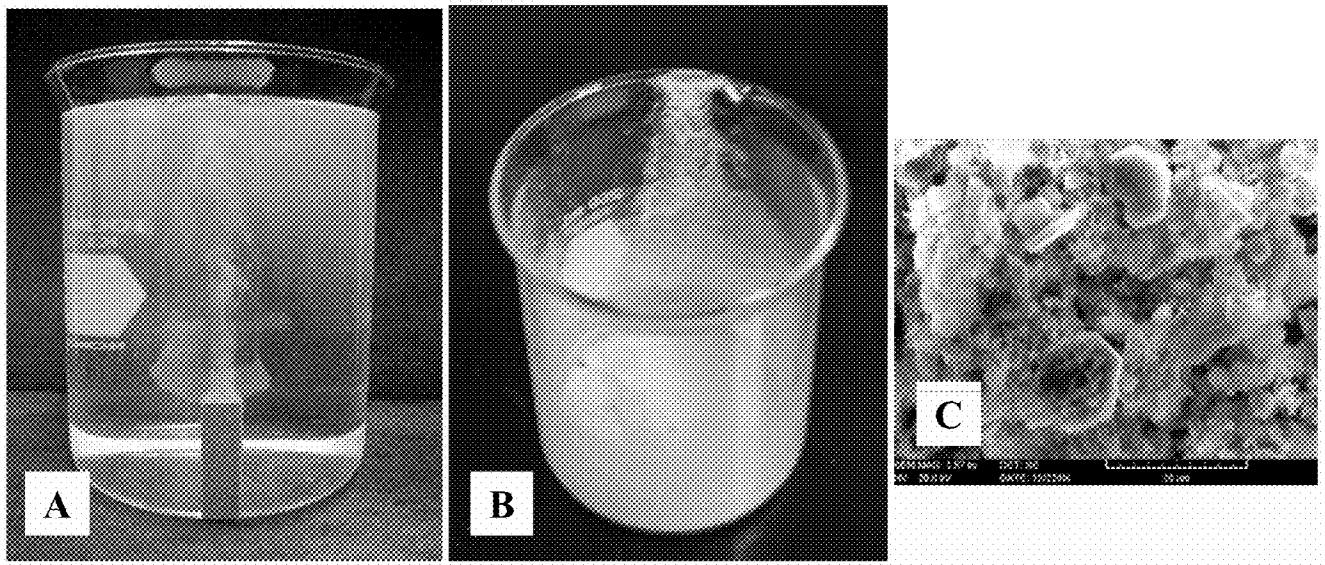
FIG. 3 illustrates an example of a metallic material that is degradable.

Embodiments of the subject disclosure comprise a plurality of magnetic particles which are transported downhole in a degradable apparatus. The degradable apparatus provides mechanical strength sufficient to protect the magnetic particles during transit down wellbores. In one non-limiting example a degradable material is a material that changes state, going from a solid initial state which is non-degradable to a final state which may be fully dissolved e.g. in solution within a solvent consisting of a well fluid or a powder form e.g. precipitates such as hydroxides or oxides. In embodiments of the subject disclosure the material which is degradable may be soluble in water and/or oil and in non-limiting examples may consist of polymers and plastics e.g. MPEO-poly(ethylene oxide), metals and alloys e.g. calcium metal, calcium-aluminum alloys, aluminum-gallium alloys, ceramics (sintered CaO-based materials), and combinations thereof. FIG. 3 depicts in one non-limiting example a metallic material e.g. calcium which is degradable. FIG. 3(*a*) depicts the metallic material immersed in ambient temperature and a neutral water. FIG. 3(*b*) depicts the resulting powder residue as a result of calcium dissolution and water evaporation and FIG. 3(*c*) is a scanning electron micrograph confirming the residues are micron-size particles.

Figure 4A:
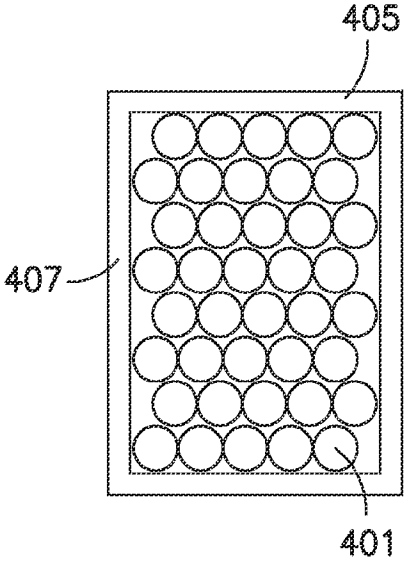
FIG. 4A-D illustrates conveying mechanisms for magnetic particles.
Figure 4B:
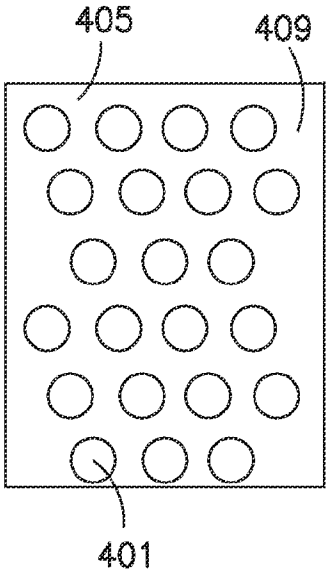
Figure 4C:
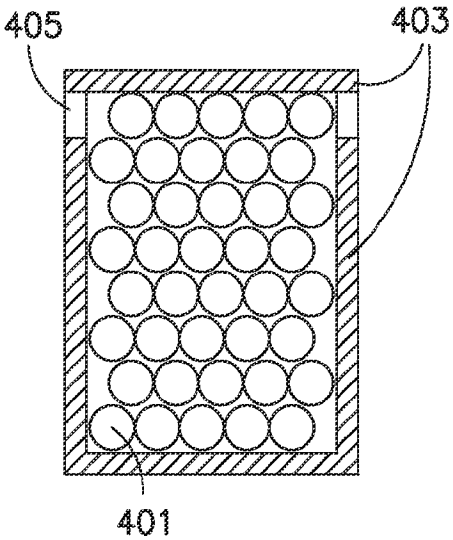

Embodiments of the subject disclosure disclose mechanisms of delivering magnetic particles using degradable materials. In one non-limiting example a plurality of particles which are magnetically attracted to one another m response to exposure to a magnetic field are used. The plurality of particles is confined within a first material, the first material degrading in response to conditions encountered in a subterranean environment and thereby releasing the particles. The plurality of particles in one non-limiting example is enclosed in a matrix of the first material. In another example the plurality of particles are clustered in a structure of the first material, FIG. 4A-C depicts the degradable material 405 and the magnetic particles 401. in FIG. 4(*a*) the magnetic particles 401 are confined within the degradable material 405. The degradable material 405 forms a shell 407 of the degradable material 405 which encases the magnetic particles 401. As the degradable material 405 degrades the magnetic particles 401 are released. In FIG. 4(*b*) the magnetic particles 401 are embedded in a degradable structure 409 comprising the degradable material 405, The degradable structure 409 encases the magnetic particles 401 and the magnetic particles 401 are released when the degradable structure 409 degrades. In FIG. 4(c) the magnetic particles 401 are confined within a non-degradable material 403 and a portion of degradable material 405. In one non-limiting example non-degradable material 403 are materials that do not degrade in subterranean well environments or if degrading occurs this degrading will not contribute to the release of magnetic particles. These non-degradable materials 405 retain their mechanical integrity in comparison to degradable materials where one or a plurality of components of the degradable material loses their mechanical integrity. In some non-limiting examples, suitable non-degradable materials are typical metals and alloys (e.g. stainless steels), plastics (e.g. PEEK or PTFE). As the degradable component degrades the magnetic particles 401 are released into the surrounding environment.

In a further embodiment of the subject disclosure an apparatus for delivering of magnetic particles downhole comprises a first material which degrades in response to conditions encountered in a subterranean environment; and a second material which is a byproduct formed from a chemical reaction between the first material and the conditions encountered in a subterranean environment. In one non-limiting example the byproduct is a plurality of particles which are magnetically attracted to one another in response to exposure to a magnetic field. The resulting plurality of magnetic particles is not part of the first material but is formed downhole as the byproduct of a reaction between the first material and the well fluid environment. The first material is therefore chemically active in the well environment and degrades into, in one non-limiting example, a plurality of magnetic powders. In the following example a non-magnetic material is transformed in-situ into magnetic particles. In one non-limiting example this transformation occurs through degradation of the non-magnetic material in-situ a wellbore into magnetic particles. The non-magnetic material may be used alone or combined with other degradable material, for example, a dissolvable polymer or metal. In one non-limiting example a first material is a magnetic material e.g. Fe attached to a molecule e.g. a polymer which may be an iron polymer, iron, copolymer or iron salt. The first material is non-magnetic or exhibits insignificant magnetism. The first material is chemically unstable in the well environment. This chemical instability may be due, in some non-limiting examples, to the presence of water, oil, pressure or temperature. Chemical instability releases Fe. In the presence of the well fluid, Fe may corrode into an oxyde ($FeO$, $Fe_2O_3$, etc.) A byproduct of this chemical instability is a suspension of magnetic particles.

Figure 4D:
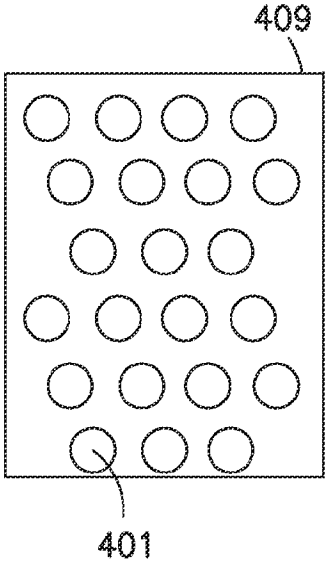

In a further embodiment of the subject disclosure a plurality of magnetic particles are confined within a flexible membrane or net (409) which is impermeable to the magnetic particles (401), as depicted in FIG. 4D. Materials useful for these flexible membrane applications include but are not limited to natural rubber, polybutadiene, nitrile, fluoroelastomers, perfluoroelastomers and silicone, and may also include other common elastomeric materials. In response to exposure to a magnetic field the volume of magnetic particles enclosed within the flexible membrane is transformed into a rigid volume. Thru the use of a flexible membrane, the suspended particles are thus trapped in a specific location and therefore may be actuated as many times as necessary since the particles are prevented from flowing away. The change from an "off" state which is a soft and deformable state to an "on" state which is a hard and much less deformable state makes possible the use of such apparatuses for in one non-limiting example wellbore zone isolation.

Embodiments of the subject disclosure may be lowered into a subterranean well by a cable or wire, or alternatively released into the well under the influence of gravity and flow induced forces. Apparatus of the subject disclosure comprising a plurality of particles which are magnetically attracted to one another in response to exposure to a magnetic field and confined within a first material which is degradable. The apparatus reaches a desired location with the assistance of in non-limiting examples wellbore geometrical features or features located on the apparatus. In some non-limiting examples a plurality of these features are employed to selectively deliver the apparatus to a desired location. In one non-limiting example selective keyed nipples are used. In non-limiting examples a wellbore tubular (e.g. production tubing, casing or liner) may include a plurality of landing nipples, such as landing nipples which are used to receive for example, wireline set tools such as permanent and temporary bridge plugs as well as other flow control devices. The landing nipples may also be located in completions accessories such as side pocket mandrels, safety valves, packers, formation isolation valves, flow control valves which are located on the production string. In one non-limiting example selective landing nipples are used which have a selection profile. These inside profiles or "key profiles" are engraved on the outside of the particle conveyance sub 113 or on one or more of its components such as the keys. Selectivity is achieved by choosing the right selection key profile on the particle conveyance sub 113 corresponding to the inside profile of the landing nipple where the tool is fit using similar principles as those commonly used in completion landing nipples and locking mandrels.

Figure 5:
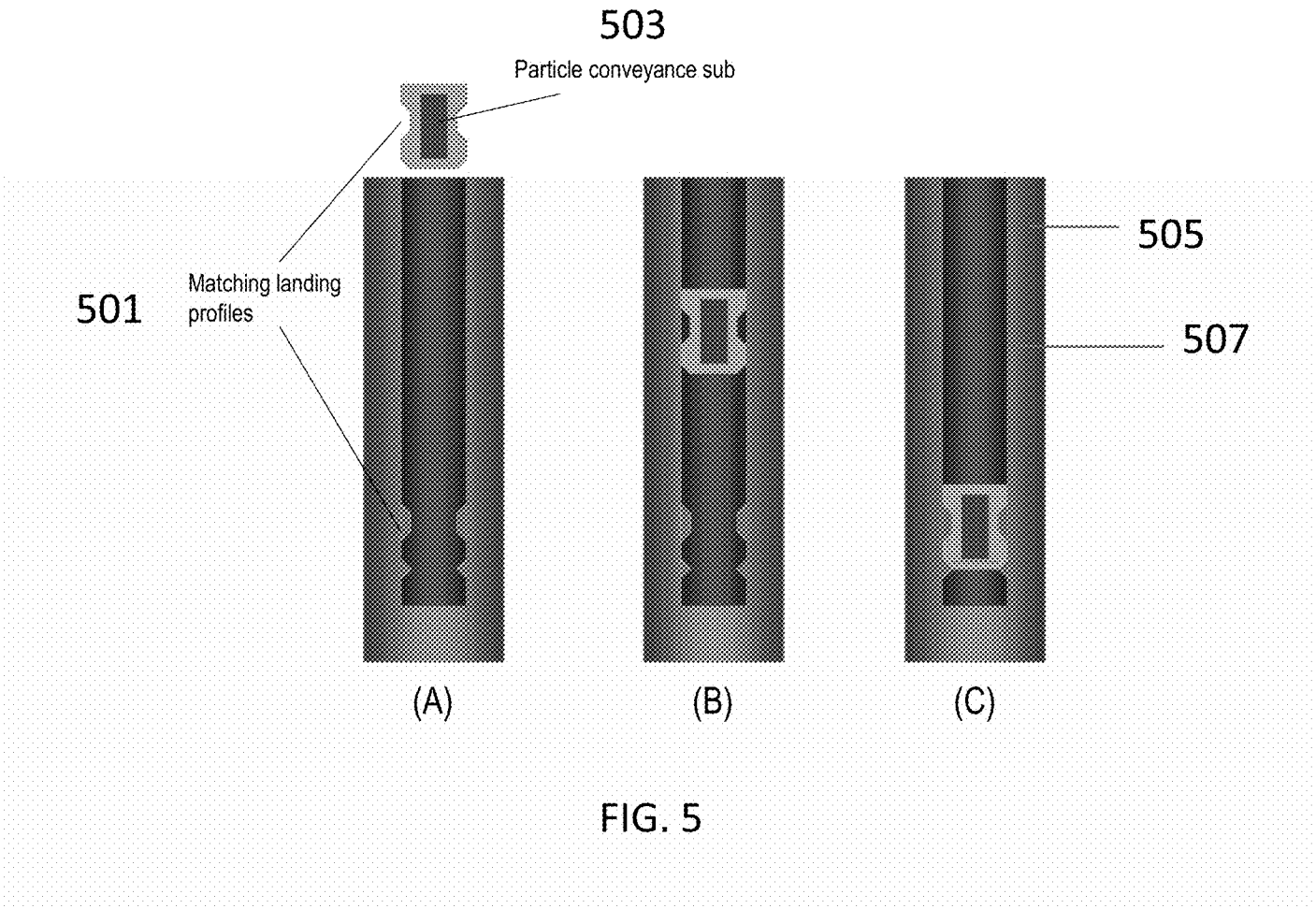
FIGS. 5A-5C illustrates seleetive landing nipples coneying magnetic particles downhole.
Figure 6:
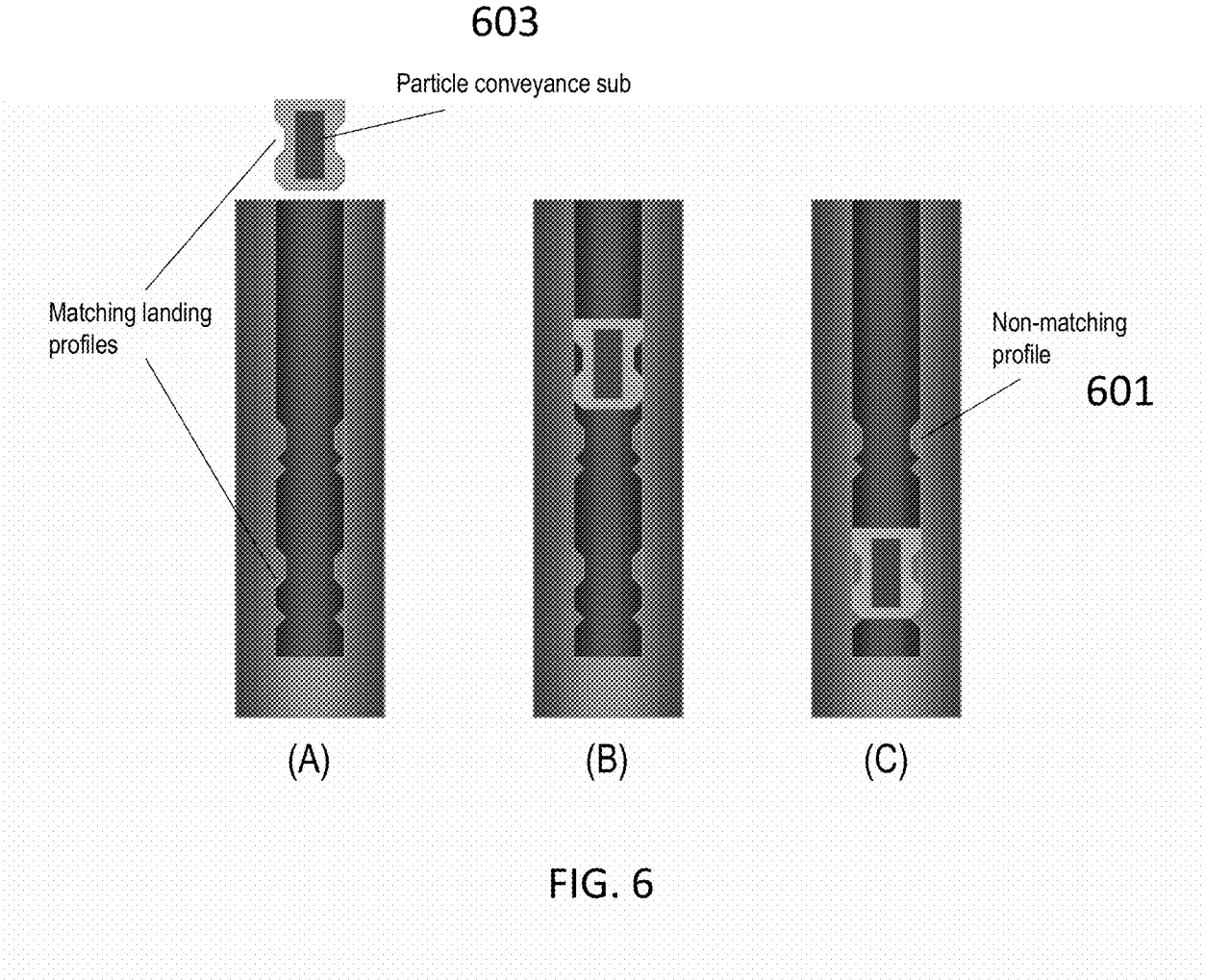
FIGS. 6A-C illustrates a plurality of landing nipples in a wellbore with each landing nipple having a different profile.

FIG. 5 depicts one targeted delivery mechanism of the subject disclosure. The plurality of magnetic particles and the degradable material 503 are delivered to a desired location by haying a key profile (501) matching a profile on the outside of the landing nipple in a certain segment of the production tubing 507 surrounded by casing 505. FIG. 6 depicts a plurality of these landing nipples. When a plurality of these landing nipples is located in a production tubing the apparatus 603 will continue to move downhole until it reaches the matching key profile. Non-matching profiles 601 are bypassed until the apparatus 603 reaches the desired location.

When the apparatus 603 reaches the desired location the degradable material will begin to degrade and eventually releases the magnetic particles. The degradable material may comprise in one non-limiting example polylactic acid (PLA) which degrades in water.

Figure 7A:
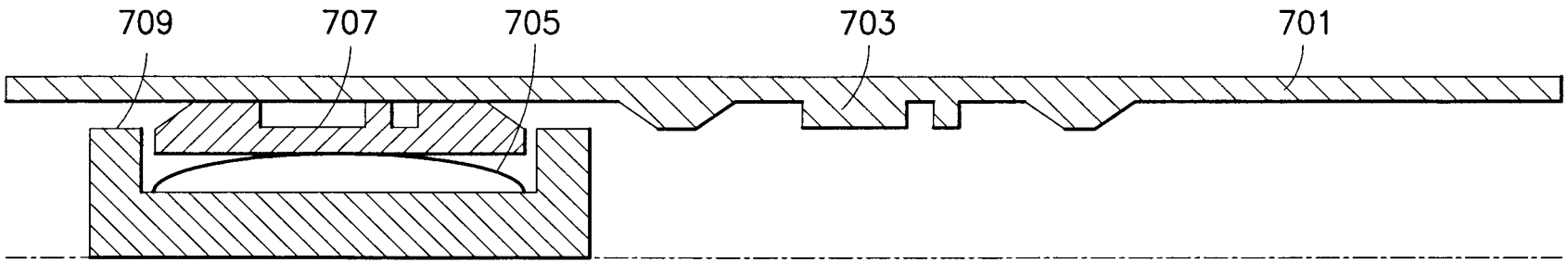
FIG. 7A-7C illustrates one example of a selective landing nipple and key mechanism.
Figure 7B:
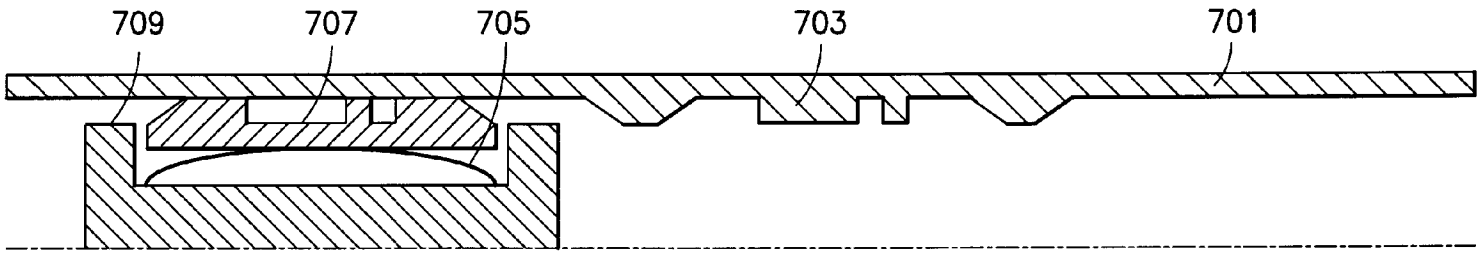
Figure 7B:
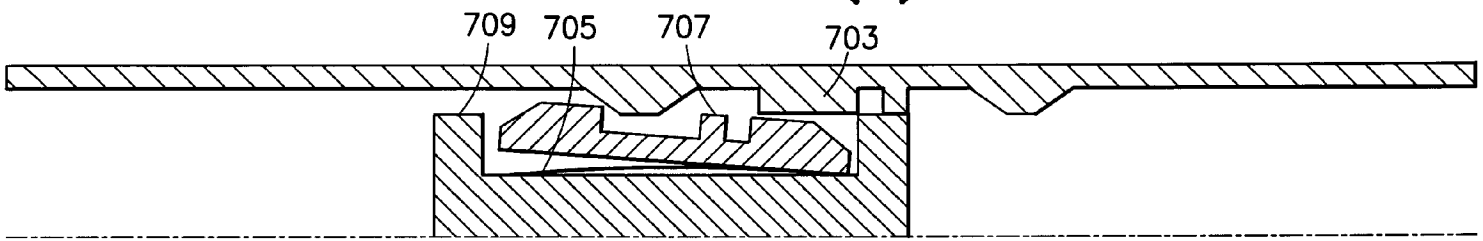
Figure 7B:
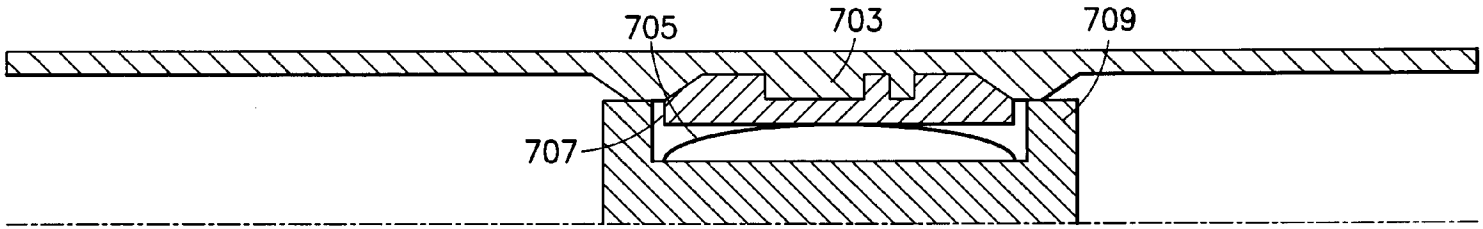
Figure 7C:
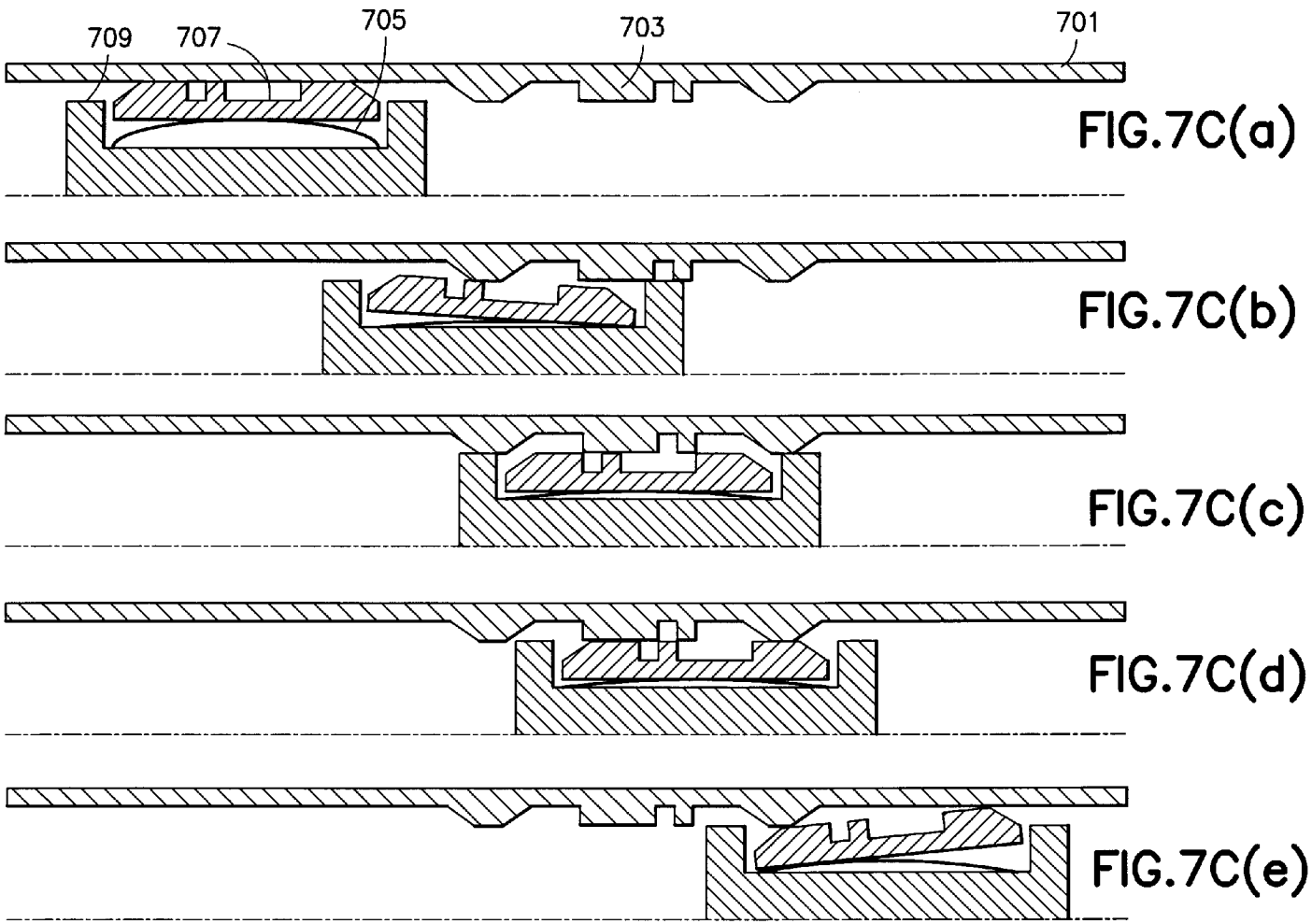

FIG. 7A-7C depicts one non-limiting example of a selective nipple and key mechanism. One or a plurality of keys (707) with a specific geometry are disposed on the particle conveyance sub (709) and are forced radially outward with a spring (705). FIG. 7B depicts a landing nipple (703) with a matching profile where the keys (707) protrude radially out and lock the particle conveyance sub (709) in that particular location in the well. FIG. 7C depicts a landing nipple with a non-matching profile where the geometrical features of the nipple (703) and the keys (707) do not allow the keys (707) to protrude and lock in the nipple (703) The particle conveyance sub (709) will therefore transverse the nipple and move further along the well tubular (701).

Figures 8A, 8B, 8C:
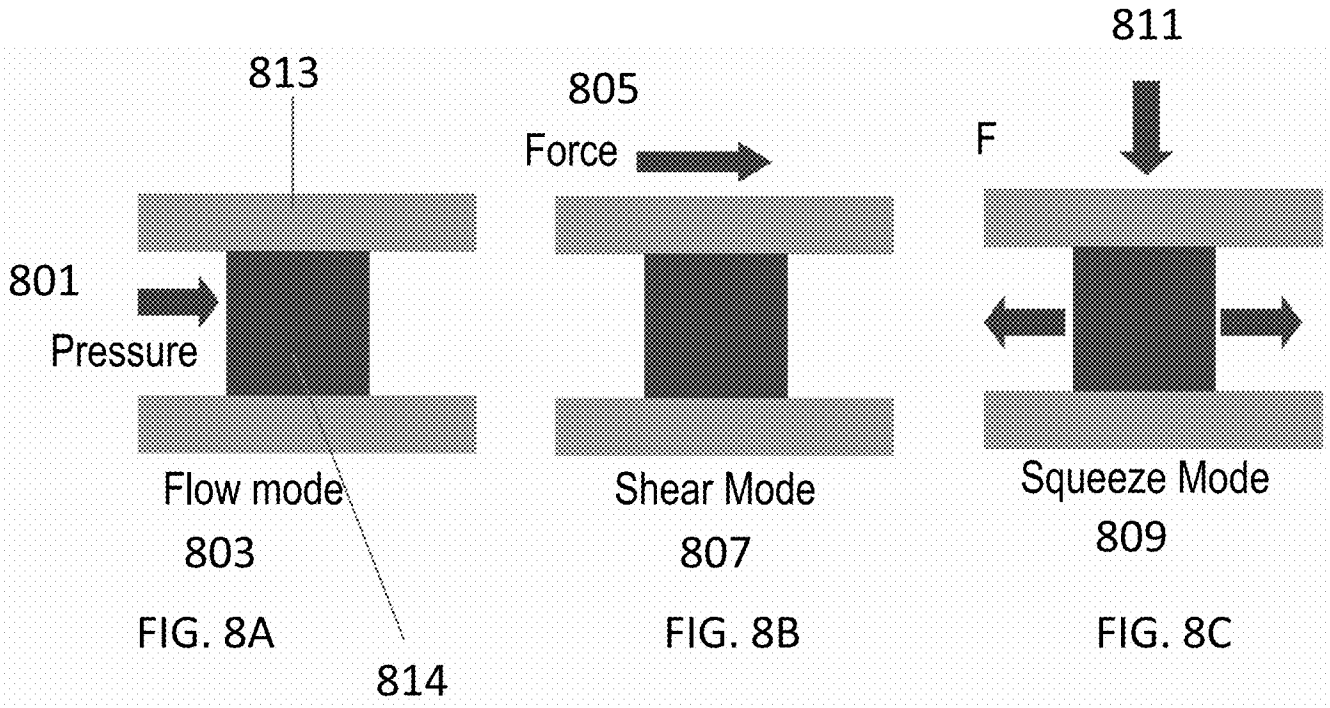
FIG. 8A-8C illustrates magnetorheological fluid modes of operation.

Once the magnetic particles are released, a portion of the well fluid, particularly the fluid located close to the apparatus, exhibits magnetorheological properties. Magnetorhelogical fluids can be used in three modes of operation, namely flow mode, shear mode and squeeze mode. FIG. 8A-C illustrates the three major types of modes which utilize magnetorheological fluid properties. FIG. 8A illustrates a flow mode 803 where the shear stress is applied by forcing the magnetorheological fluid 814, in the direction 801, through a channel 813.

In the flow mode the magnetically formed chains of particles act as a plug to fluid flow through a fluid channel, effectively becomes a magnetic valve. FIG. 8B illustrates a shear mode 807 where the fluid is sheared by tangential relative motion 805 of fluid boundaries. FIG. 8C illustrates a squeeze mode 809 where magnetic particles resist normal relative motion 811 of fluid boundaries. In the shear and squeeze modes of operation, the magnetic chains are used to control the resistance to motion between two or more components. Common examples where these modes are utilized are in magnetorheological clutches, brakes or squeeze film dampers. The magnetic field necessary to modify the magnetorheological fluid behavior can be generated by for example, an electromagnetic coil. The magnetic field may also be present in the wellbore e.g. a permanently magnetized element.

Figure 9:
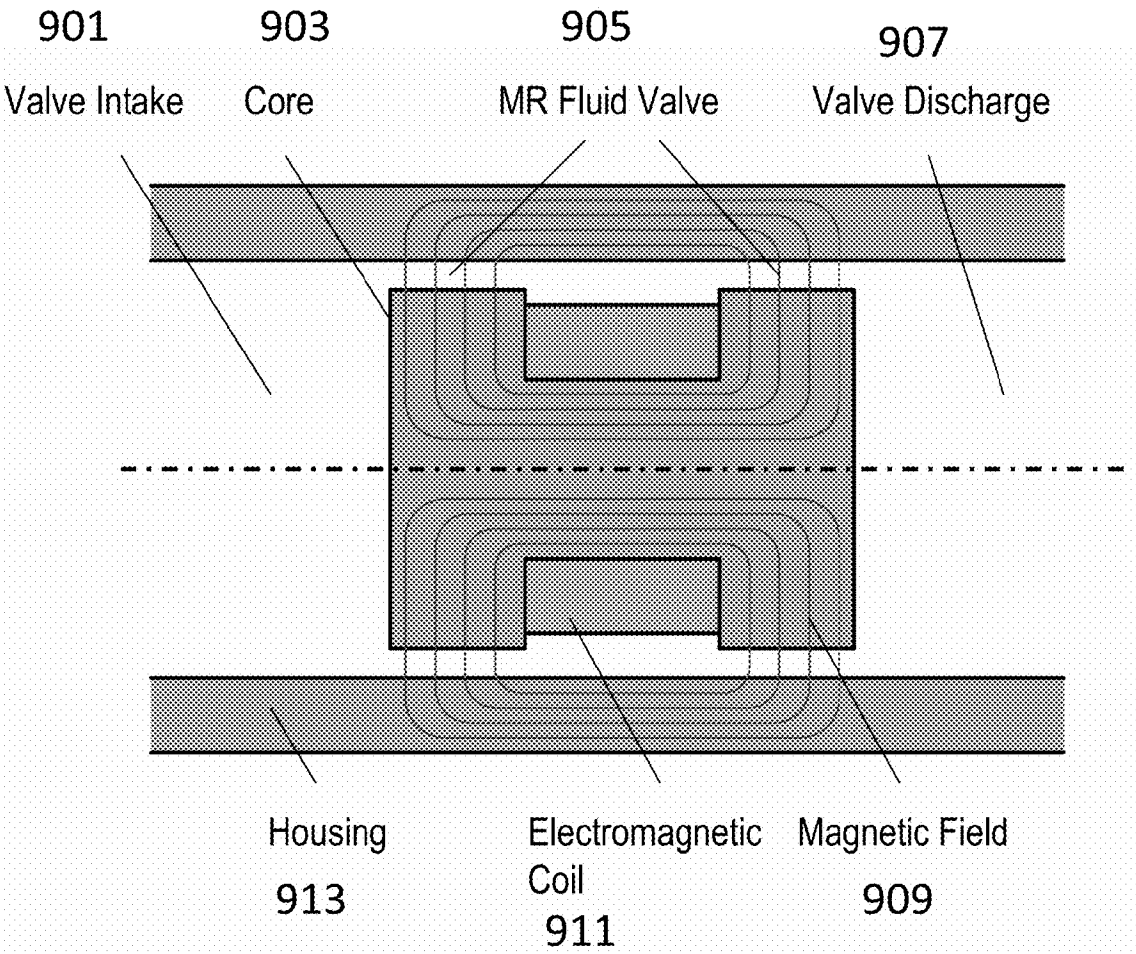
FIG. 9 illustrates a magnetorheological fluid valve.

FIG. 9 illustrates an example of a magnetorheological fluid device 905 operating in a flow mode by magnetic fields 909 generated by an electromagnetic coil 911. The device 905 which is a magnetorheological valve comprises a housing 913 and a core 903. The magnetorheological valve comprises a valve intake 901 and a valve discharge 907. When electrical current is present in the coil 911, a magnetic field 909 is generated. Magnetorheological fluid flowing through the device 905 exerts an additional resistance to flow in the presence of a magnetic field 909. When there is no net electrical current flowing through the coil, the magnetic field within the device 905 is effectively zero, neglecting remnant magnetization of the components. The magnetorheological fluid flow occurs with less resistance when the magnetic field is not present.

In a further embodiment, magnetism of "leftover" particles in a degradable material can be used to attract the debris of the degradable reaction to minimize wellbore debris. Magnetic force is present on a particle placed in a gradient of magnetic field strength. Therefore, by creating a gradient using permanent magnets or electromagnetic coils, particles can be attracted to a preferred location in the wellbore. This attraction may pull away magnetic particles or the degradable or non-degradable components they may be embedded in.

Figure 10:
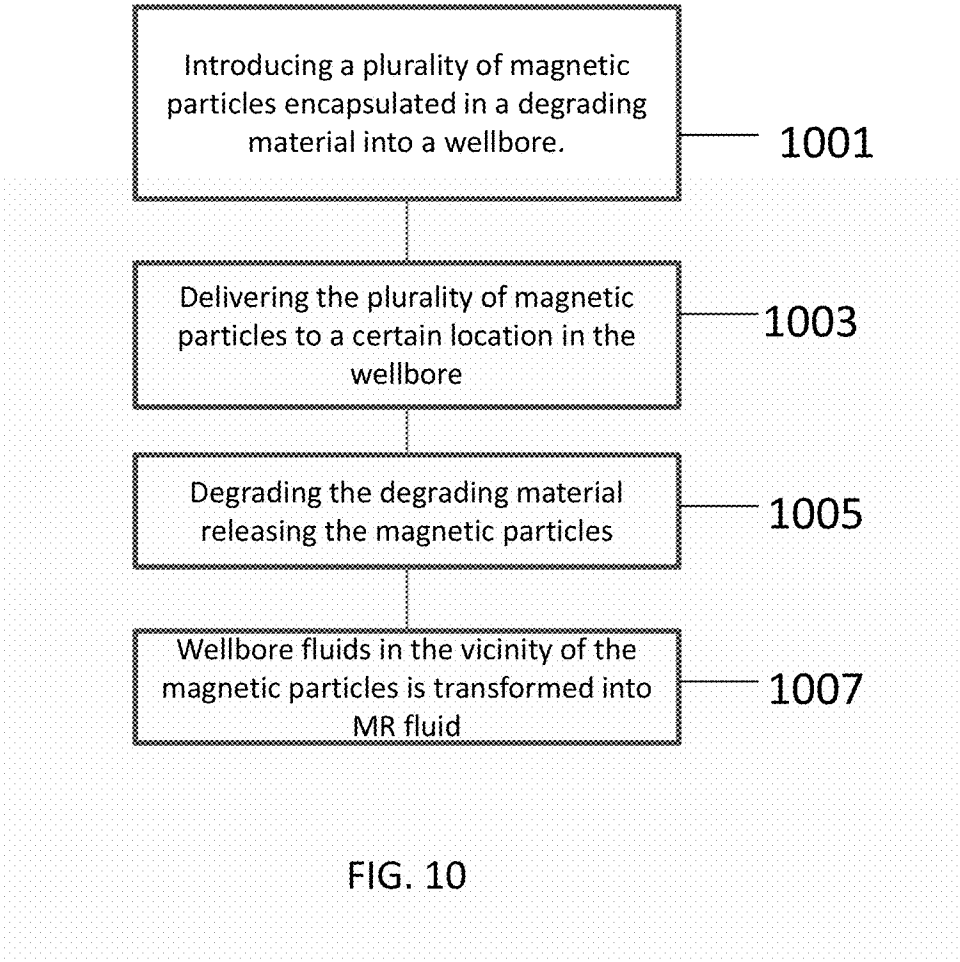
FIG. 10 illustrates a flow chart of one method of the subject disclosure.

FIG. 10 illustrates one method of the subject disclosure. A plurality of magnetic particles encapsulated in a degrading material (1001) is introduced into a wellbore. The plurality of magnetic particles is delivered to a certain location in the wellbore (1003). Once the plurality of magnetic particles reaches its destination the degradable material begins to degrade gradually releasing the magnetic particles. Once the magnetic particles are released they transform the surrounding fluid into magnetorheological fluid (1007).

While the subject disclosure is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. An apparatus comprising:

a plurality of particles magnetically attracted to one another in response to exposure to a magnetic field;

a first material in which the plurality of particles is confined within the first material, the first material degrading in response to conditions encountered in a subterranean environment and thereby releasing the particles;

the first material comprising a first geometrical profile;

a second geometrical profile positioned on an inner surface of a wellbore;

wherein a matching first geometrical profile is adapted to engage the second geometrical profile; and wherein the first and second geometrical profiles are used to position the plurality of particles within the wellbore.

2. The apparatus of claim 1 wherein the plurality of particles is confined in a degradable shell of the first material.

3. The apparatus of claim 1 wherein the plurality of particles is confined in a degradable structure of the first material.

4. The apparatus of claim 1 further including a second material wherein the plurality of particles is confined within the first and the second material and wherein the second material does not degrade in response to conditions encountered in the subterranean environment.

5. The apparatus of claim 1 wherein the first material changes state going from a solid initial state to a final state that is dissolved or in a powder form.

6. The apparatus of claim 1 wherein the first material is soluble in water and/or oil.

7. The apparatus of claim 1 wherein the first material is selected from the group consisting of polymers, plastics, metals, alloys, ceramics, and combinations thereof.

8. The apparatus of claim 7 wherein the plastics are MPEO-poly (ethylene oxide).

9. The apparatus of claim 7 wherein the metals are calcium.

10. The apparatus of claim 7 wherein the alloys are a calcium-aluminum alloy.

11. The apparatus of claim 1 wherein the apparatus is lowered into a wellbore by a cable or wire.

12. The apparatus of claim 1 wherein the apparatus is lowered into a wellbore under the influence of gravity.

13. The apparatus of claim 1 wherein the apparatus is lowered into a wellbore by fluid flow induced forces.

14. The apparatus of claim 1 wherein the second geometrical profile is one or a plurality of landing nipples positioned on the inner surface of the wellbore.

15. The apparatus of claim 14 wherein the apparatus is lowered into the wellbore and mates with the one or plurality of landing nipples positioned in the wellbore.

16. The apparatus of claim 14 wherein the one or a plurality of landing nipples are positioned along an inner surface of a tubing string in the wellbore.

17. The apparatus of claim 1 wherein the plurality of particles is used in a downhole valve.

18. The apparatus of claim 1 wherein the first geometrical profile is a key profile and the second geometrical profile is a landing profile.

19. An apparatus for delivering magnetic particles downhole comprising:

a first material which degrades in response to conditions encountered in a subterranean environment; wherein magnetic particles are generated from a byproduct formed from a chemical reaction between the first material and the conditions encountered in the subterranean environment;

the first material comprising a first geometrical profile;

a second geometrical profile positioned on an inner surface of a wellbore;

wherein a matching first geometrical profile is adapted to engage the second geometrical profile; and wherein the first and second geometrical profiles are used to position the magnetic particles within the wellbore.

20. An apparatus for delivering magnetic particles downhole comprising:

a plurality of particles magnetically attracted to one another in response to exposure to a magnetic field;

a flexible membrane which is impermeable to the plurality of particles;

the first material comprising a first geometrical profile;

a second geometrical profile positioned on an inner surface of a wellbore;

wherein a matching first geometrical profile is adapted to engage the second geometrical profile; and wherein the first and second geometrical profiles are used to position the plurality of particles within the wellbore.

21. The apparatus of claim 20 wherein a magnetic field transforms the flexible membrane into a rigid membrane.

22. A method for delivering magnetic particles downhole comprising:

introducing a plurality of energy field responsive particles which form chains in response to an energy field;

confining the particles in a first material, the first material degrading in response to conditions encountered in a subterranean environment and releasing the particles;

the first material comprising a first geometrical profile;

a second geometrical profile positioned on an inner surface of a wellbore wherein a matching first geometrical profile is adapted to engage the second geometrical profile; and positioning the magnetic particles in the wellbore using the first and second geometrical profiles.

23. The method of claim 22 wherein the plurality of energy field responsive particles is confined in a degradable shell of the first material.

24. The method of claim 22 wherein the plurality of energy field responsive particles is confined in a degradable structure of the first material.

25. The method of claim 22 further including a second material wherein the plurality of energy field responsive particles is confined within the first and the second material and wherein the second material does not degrade in response to conditions encountered in a subterranean environment.

* * * * *